US006064309A

United States Patent [19]

Sellers et al.

[11] Patent Number: 6,064,309

[45] Date of Patent: May 16, 2000

[54] SWIMMING POOL DROWNING PREVENTION SYSTEM

[76] Inventors: Scott D. Sellers, 707 E. Papago Dr., Tempe, Ariz. 85281; Edward C. Frieberg, 3140 S. Beverly Cir., Mesa, Ariz. 85210

[21] Appl. No.: 09/162,211

[22] Filed: Sep. 28, 1998

[51] Int. Cl.[7] ..... G08B 23/00

[52] U.S. Cl. ..... 340/573.6; 340/573.1; 340/541; 340/539; 340/604; 340/566; 340/628; 623/24; 128/781

[58] Field of Search ..... 340/573.6, 573.1, 340/541, 539, 604, 566, 628; 623/24; 128/781

[56] References Cited

U.S. PATENT DOCUMENTS

| | | | |
|---|---|---|---|
| 5,053,752 | 10/1991 | Epstein et al. | 340/628 |
| 5,086,290 | 2/1992 | Murray et al. | 340/539 |
| 5,469,861 | 11/1995 | Piscopo et al. | 128/781 |
| 5,736,937 | 4/1998 | McGirr et al. | 340/870 |
| 5,828,304 | 10/1998 | Mowday | 340/566 |
| 5,888,212 | 3/1999 | Petrofsky et al. | 623/24 |
| 5,900,817 | 5/1999 | Olmassakian | 340/573.1 |

*Primary Examiner*—Daniel J. Wu
*Assistant Examiner*—Tai T. Nguyen
*Attorney, Agent, or Firm*—Harry M. Weiss; Jeffrey Weiss; Paul W. Davis

[57] ABSTRACT

A swimming pool drowning prevention safety system. The swimming pool drowning prevention safety system comprises: an article wearable by a person, a radio frequency transmitting device coupled to the article for transmitting a radio frequency signal, a microprocessor controlled radio frequency receiving station for receiving the radio frequency signal from the radio frequency transmitting device when the radio frequency transmitting device is within a user adjustable radio reception range of the radio frequency receiving station, and an alert signaling device coupled to the radio frequency receiving station for signaling when the person wearing the article has come within the user adjustable radio reception range of the radio frequency receiving station. The swimming pool drowning prevention safety system is further comprised of an adjustable gain control for varying the RF sensitivity of the radio frequency receiving station, and an RF sensitivity trigger circuit coupled to an audio messaging system for broadcasting at least one selected alert message. The swimming pool drowning prevention safety system further comprises telephone circuitry connection equipment for automatically connecting to a telephone system and transmitting the selected alert message. The swimming pool drowning prevention safety system further comprises a microprocessor that controls and integrates operation of the radio frequency receiving station.

18 Claims, 2 Drawing Sheets

SWIMMING POOL DROWNING PREVENTION SYSTEM

BACKGROUND OF THE INVENTION

1. Field of the Invention

This invention relates generally to swimming pools and personal safety systems, and more particularly, to a system for a child or adult anti-drowning system comprising a radio transmitter system worn by a person, and a radio receiver system, located next to a swimming pool, that responds or reacts if the person wearing the radio transmitter system approaches the swimming pool area.

2. Description of the Related Art

Historically, anti-drowning safety devices for children or adults have fallen into two main categories: The first category is the type of safety device that involves actual contact with the water by a device worn by a person. Upon contact with the water, the device signals a receiver, utilizing some portion of the electromagnetic spectrum, and the receiving device then broadcasts some type of alarm. The second category of safety devices involves those in which actual water contact does not occur. In this category, the person to be protected is wearing a transmitter that establishes a radio link, in a continuous mode, with a receiver. This type of system generally involves a loop antenna surrounding the swimming pool. The receiver receives a continuous signal from the loop antenna's reception of the person's transmission signal. When the person approaches within a certain distance of the loop antenna, the receiver detects an increased signal strength from the loop antenna. This increased signal strength results in an alarm condition as described in the first category.

These systems possess drawbacks, however. The water contact category systems require actual contact with the water before an alarm occurs. This means that the person to be protected is already in the water and may be drowning even as the alarm is activated. Obviously, this system responds much too late. The non-water contact systems also have drawbacks, however. These systems establish a continuous radio link between the transmitter worn by the person and the receiver located poolside. This continuous radio link then varies in signal strength depending on the proximity of the person and their transmitter to the swimming pool receiver and the loop antenna. The drawbacks to the continuous radio link systems include: interference may cause a signal interruption thus resulting in false alarms, or no alarms whatsoever; and the person may stray outside the reception area thereby resulting in false alarms, system failure, etc; and finally, the transmitter required to be worn by the person is quite large and is strapped onto the person as a backpack which results in a cumbersome and easily damaged system. Additionally, this system is not liked by children beyond the initial thrill of the first five minutes of wearing it, as the system will get in the way during the child's regular activities such as sitting in a chair, trying to lie down, etc.

Therefore a need existed for a system that would activate before a person was actually in the water. Additionally, a need existed for a system that did not require a continuous radio link between the transmitter worn by the person and the receiver located poolside. Yet another need existed for a system that would not be subject to interference or loss of the radio link. A final need existed for a system that would be small, compact, and durable, such that the wearing of the system by the person would be easily accomplished and would not interfere with a person's normal activities.

SUMMARY OF THE INVENTION

An object of the present invention is to provide a drowning prevention system that activates before a person using the system is actually in the water.

Another object of the present invention is to provide a system that does not require a continuous radio link between the transmitter worn by the person using the system and the receiver located poolside.

Yet a further object of the present invention is to provide a system that will be small, compact, and durable, such that the wearing of the system by the person will be easily accomplished and will not interfere with a person's normal activities.

BRIEF DESCRIPTION OF THE PREFERRED EMBODIMENTS

In accordance with one embodiment of the present invention, a swimming pool drowning prevention safety system is disclosed. The swimming pool drowning prevention safety system comprises: an article wearable by a person, radio frequency transmitting device coupled to the article for transmitting a radio frequency signal, radio frequency receiving station for receiving the radio frequency signal from the radio frequency transmitting device when the radio frequency transmitting device is within a user adjustable radio reception range of the radio frequency receiving station means, and an alert signaling device coupled to the radio frequency receiving station for signaling when the person wearing the article has come within the user adjustable radio reception range of the radio frequency receiving station means.

In accordance with another embodiment of the present invention a drowning prevention safety system is disclosed. The drowning prevention safety system, comprises: an article wearable by a person, radio frequency transmitting device coupled to the article for transmitting a radio frequency signal, radio frequency receiving station for receiving the radio frequency signal, for signaling coupled to the radio frequency receiving station for signaling when the person wearing the article has come within a user adjustable radio reception range of the radio frequency receiving station means, a battery power coupled to the radio frequency transmitting device for supplying operating power for the radio frequency transmitting device wherein the battery power further comprises a low-battery indicator coupled to the battery power means, wherein the radio frequency receiving station is a microprocessor controlled radio frequency receiving station for receiving the radio frequency signal from the radio frequency transmitting device when the radio frequency transmitting device is within the user adjustable radio reception range of the microprocessor controlled radio frequency receiving station means. The microprocessor controlled radio frequency receiving station comprises: an adjustable gain control for varying the RF sensitivity of the microprocessor controlled radio frequency receiving station means, an RF sensitivity trigger circuit having at least one alarm activation level circuit, wherein the at least one alarm activation level circuit is adjustable to correspond to the user adjustable radio reception range of the microprocessor controlled radio frequency receiving station means, and wherein the at least one alarm activation level circuit is coupled to the for signaling, wherein the for signaling is coupled to an audio messaging for broadcasting at least one selected alert message, and telephone circuitry connection coupled to the audio messaging for automatically connecting to a telephone system, dialing at least one telephone number, and transmitting the at least one selected alert message.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
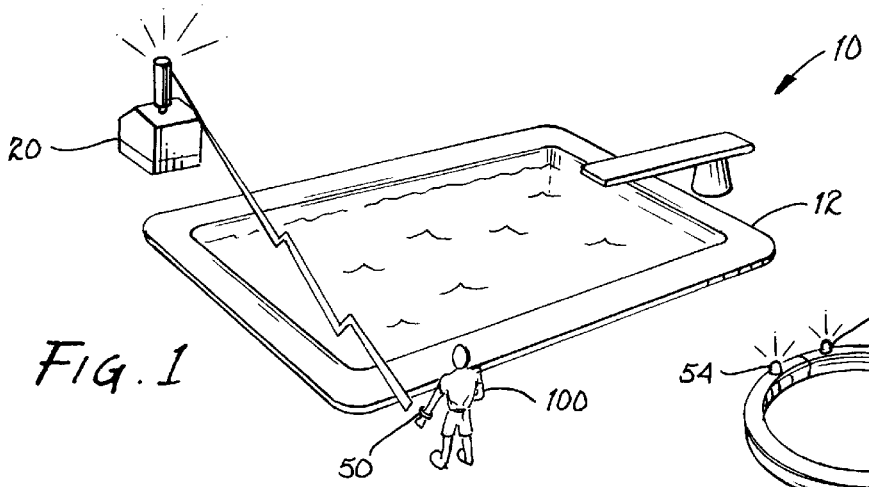
FIG. 1 is a simplified drawing of the swimming pool drowning prevention safety system of the present invention.

Referring to FIG. 1, a simplified drawing of a preferred embodiment of the swimming pool drowning prevention safety system of the present invention, hereinafter the "system 10" is shown. The system 10 preferably comprises a wearable article 50 ("wearable article 50" hereinafter) worn upon the person to be protected 100 ("100" hereinafter) and a radio frequency receiving station 20 ("RFRS 20" hereinafter). The system 10, in a preferred embodiment, is operated proximate to a swimming pool 12 in the following manner. The RFRS 20 is placed proximate to a swimming pool 12 such that the RFRS 20's area of radio reception will encompass all the water area of the swimming pool 12. As will be explained later in more detail, the RFRS 20's range of reception is adjustable to accommodate different sizes of swimming pools or desired areas of protection. The wearable article 50 is placed upon the person 100. If the person 100 wearing the wearable article 50 enters the RFRS 20's area of radio reception, the RFRS 20 will issue an alert, or series of alerts. Though the system 10 in a preferred embodiment is used proximate to a swimming pool 12, the present invention may also be used for other areas or purposes in which it is desired to broadcast an alert if a person 100 approaches. These alternative uses could include, for example, without being limited to, the monitoring: of egress and exit areas such as gates and doors; medical supply rooms; hazardous material or work areas; etc. The person 100 could be a child, as is applicable in a preferred embodiment and use of the system 10, but the person 100 could also be an adult who is suffering from dementia, or some other impairment of mental skills such that the person 100 is not able to appreciate the potential danger inherent in some areas such as accessible swimming pools, toxic chemical store rooms and the like, or even the danger in leaving a building and wandering off.

Figure 2:
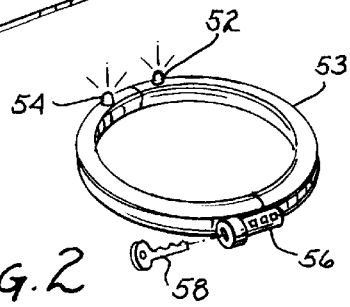
FIG. 2 is a simplified drawing of a preferred embodiment of the present invention featuring a locking bracelet which contains the RF battery-powered transmitter of the present invention.

Referring to FIG. 2, a simplified drawing of the present invention featuring a wearable article 50 which contains the RF battery powered transmitter apparatus 51 ("apparatus 51" hereinafter) (see FIG. 5) of the present invention is shown. As is depicted, in a preferred embodiment of the present invention, the wearable article comprises a locking bracelet 53. However, the wearable article 50 may also comprise without departing from the spirit or scope of the invention, ornaments for wear including a pendent, an earring, a belt buckle, a pin, a ring, or other article comfortably worn by a person 100. The bracelet 53 comprises a lock 56 operated by a key 58 which serves to fasten the bracelet 53 upon a person 100 (FIG. 1) such that the bracelet 53 cannot inadvertently be removed or lost. The bracelet 53, in a preferred embodiment, is available in two sizes in order to fit both children and adults. The bracelet 53 has additional features comprising; a transmitter-in-operation LED 52 to enable the user of the system (not shown) to visually verify the correct operation of the bracelet 53 signal transmission. The bracelet 53 also comprises a low battery alarm 54 to alert the user to a low charge condition of the battery coupled to the bracelet 53.

Figure 5:
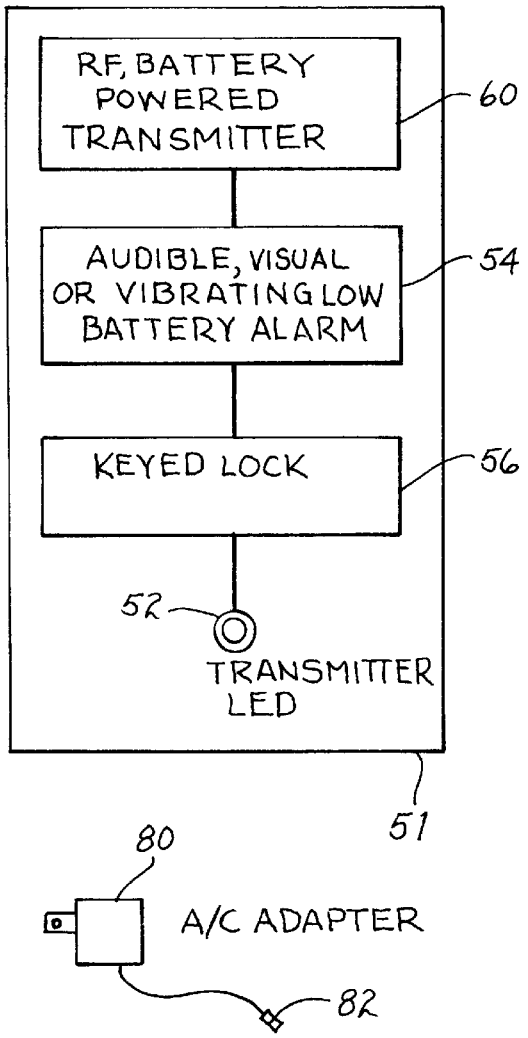
FIG. 5 is a functional block diagram of the wearable article which contains the RF battery-powered transmitter.

Referring to FIG. 5, a functional block diagram of the RF battery powered transmitter apparatus 51 contained within the wearable article 50 of FIG. 1 is shown. The apparatus 51 comprises an RF battery powered transmitter 60 which broadcasts a continuous signal. The continuous signal is of low power such that the transmission range of the RF battery powered transmitter 60 is very limited. This low power also enables a longer time period between new batteries or recharging the batteries than is possible with higher power systems. The proper operation of the RF battery powered transmitter 60 is indicated by the operation of the transmitter LED 52 upon the wearable article 50. The apparatus 51 further comprises an audible, visual or vibrating low battery alarm 54. The low battery alarm is designed to provide an alert to a wide range of users or persons 100. The low battery alert may consist of a low battery LED 54, as shown in FIG. 2, which will provide a visual alert. An alternate or additional low battery alarm 54 may comprise an audible alert (not shown) utilizing, as is well known in the art, some form of audible alert, such as pagers or beepers use, and which is generally known as a SONALERT™. Additionally, the low battery alarm 54 may comprise a silent vibrating alert such as pagers or beepers use. The RF battery powered transmitter 60 is provided with electrical power by one of two methods. Either a battery (not shown), is coupled to the RF battery powered transmitter 60, and the battery is replaced by the user when necessary, or a rechargeable battery (not shown) is coupled to the RF battery powered transmitter 60 and is recharged by an external A/C adapter 80 which has a plug 82 to couple to the wearable article 50.

Figure 3:
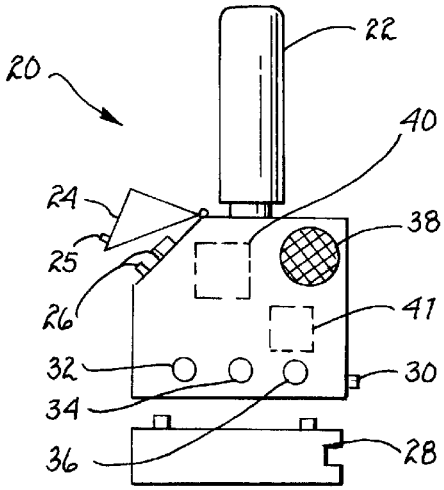
FIG. 3 is a simplified drawing of the Radio Frequency Receiving Station (RFRS) of the present invention.

Referring to FIG. 3. a simplified drawing of the Radio Frequency Receiving Station (RFRS) 20 of the present invention is shown. The RFRS 20 comprises a portable unit manufactured of materials resistant to the elements. In a preferred embodiment, the RFRS 20 also comprises an RFRS base 28 to which the RFRS 20 may be lockably coupled to provide for semi-permanent operation. The RFRS base 28 itself is designed to be semi-permanently mounted in a desired location and comprises mounting holes, brackets or other means (not shown) for fastening the RFRS base 28 to the ground, to a wall or such other suitable location as the user of the system 10 may desire. The base lock 30, comprised by the RFRS 20, may then be used to secure the RFRS 20 to the RFRS base 28 to prevent the unauthorized removal of the RFRS 20. The base lock 30 may be operated with the key 58 that is used to operate the bracelet lock 56 upon the bracelet 53. The RFRS 20 further comprises an antenna 22 for reception of the RF signal broadcast by the RF battery powered transmitter 60. The RFRS 20 further comprises the RFRS circuitry 40 housed internal to the RFRS 20, and the RFRS battery backup equipment 41 also housed internal to the RFRS 20. The RFRS battery backup equipment 41 comprises means for maintaining power to the RFRS 20 in the event that the supplied A/C power is interrupted. Also included in the RFRS 20 is one or more internally mounted speakers 38. The speakers 38 are used to broadcast the alerts programmed into the system 10. The RFRS 20 further comprises a telephone system connection 32 for coupling to a conventional or wireless telephone system (not shown). The RFRS 20 further comprises a Ground Fault Interrupter (GFI) protected power connection 34, and external speaker connections 36. The GFI protected power connection protects the user and other persons from electric shock in the event the RFRS 20 is touched while a malfunction of the RFRS 20 has occurred. The external speaker connections 36 allow the user to add additional speakers to the system 10. The additional speakers may be located inside a house, (not shown) or used to provide additional volume for broadcasting the alert. The RFRS 20 also comprises the RFRS control panel 26. Covering the RFRS control panel 26 is the control panel cover 24 to prevent unauthorized or inadvertent access. The cover 24 comprises a cover lock 25 to secure the cover 24 in the closed position. The cover lock 25 may be operated with the key 58 that is used to operate the bracelet lock 56 upon the bracelet 53.

Figure 4:
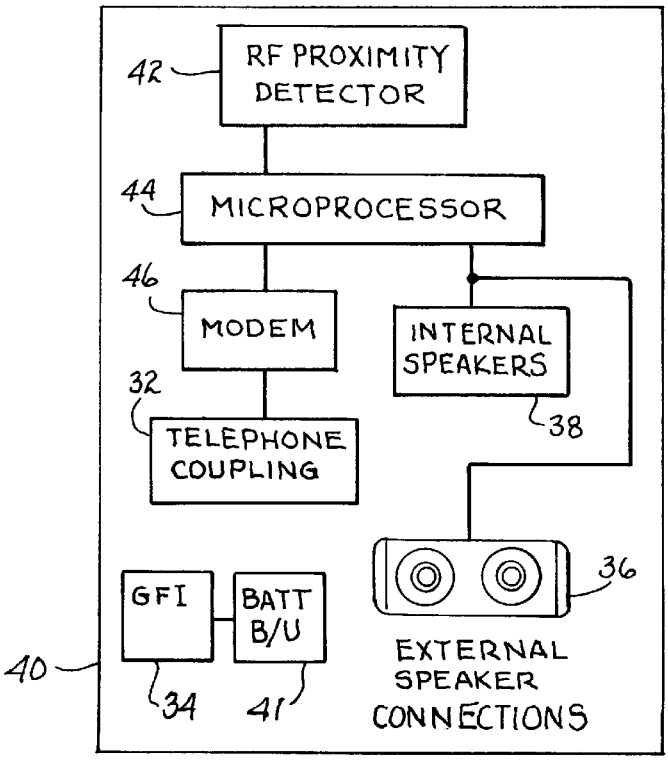
FIG. 4 is a functional block diagram of the RFRS circuitry of FIG. 3.

Referring to FIG. 4, a functional block diagram of the RFRS circuitry 40 of FIG. 3 is shown. The RFRS circuitry 40 comprises an RF proximity detector 42. The RF proximity detector 42 comprises an RF receiver system (not shown) as is well known to those skilled in the art. The RF proximity detector 42 is coupled to and controlled by a microprocessor 44 in a manner known to those skilled in the art. Also coupled to and controlled by the microprocessor 44 is a modem 46. The modem 46 is used to couple to the telephone system connection 32. Also depicted is the GFI protected power connection 34, and the RFRS battery backup equipment 41.

Figure 6:
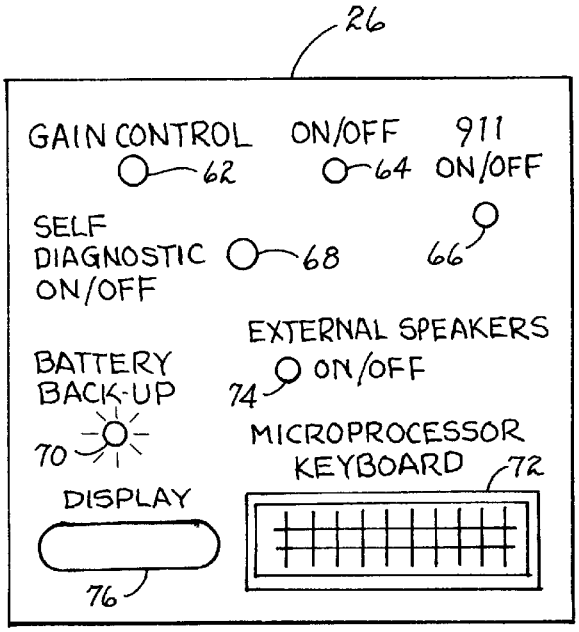
FIG. 6 depicts the Control Panel of the RFRS of FIG. 4.

Referring to FIG. 6, the Control Panel 26 of the RFRS 20 is shown. The control panel 26 comprises controls for: System Power On/Off 64, RF gain control 62, "911" enable On/Off 66, Self Diagnostic Notify On/Off 68, External Speakers Enable On/Off 74, Battery Backup functioning indicator 70, the microprocessor keyboard 72, and the microprocessor display 76.

Operation

Though the description of operation below follows a sequential order, this is done merely as a convenience to present a logical and easily followed progression through the various operational steps e.g. the next step performed is . . . However, it should be understood that many of these steps may be performed in any order without limiting or affecting the operation of the present invention.

The system 10, in a preferred embodiment, is operated in the following manner. The RFRS 20 is placed next to the swimming pool 12, or proximate to such other area as is desired. The RFRS base 28 is affixed to a surface in a desired area, the RFRS 20 is placed upon and secured to the RFRS base 28 by using the key 58 to operate the base lock 30. Following the mounting of the RFRS 20, electrical power is run to the RFRS 20 and connected to the GFI power connection 34. Next a telephone connection is made to the telephone system connection 32. The telephone system coupled to (not shown) may comprise a standard telephone system, but may also comprise a wireless telephone system. This telephone connection will enable the system 10 to broadcast alert messages to the pre-programmed telephone numbers. The pre-programmed telephone numbers may include, for example, a user's telephone number, a beeper or pager number for the user or others, the user's cellular telephone, the 911 emergency number, local fire, police etc. In a preferred embodiment, any one or more of these telephone numbers may be programmed into the system 10 for calling by the system 10. As an option, the user may also choose to couple additional speakers (not shown) to the system 10 by coupling them to the external speaker connections 36. The optional additional speakers may be located in a dwelling near the swimming pool 12, such as the user's house, or at such other location as would be desired to hear the alert messages broadcast by the RFRS 20.

In a preferred embodiment, the wearable article 50 is placed upon the person 100 and, if so equipped, the key 58 used to operate the lock 56 to secure the wearable article 50 upon the person 100. The transmitter-in-operation LED 52 is checked to ensure that the RF battery powered transmitter 60 is broadcasting, and the low battery alarm 54 LED is checked to verify that a low battery condition is not present.

The RFRS 20 is turned on by operating the System Power On/Off 64 control to the on position. The microprocessor 44 functions are next programmed for the desired responses using the microprocessor keyboard 72, and the microprocessor display 76. The user first selects the number of alert levels desired for the RFRS 20's response. In the present embodiment three alert levels may be used, though those skilled in the art will recognize that other numbers of levels may be used without limiting the scope of the present invention. The different alert levels correspond to the length of time the person 100, having the wearable article 50, is within the defined area as selected by the user adjustable radio reception range of the RFRS 20. The longer the person 100 remains in the defined area, the higher the alert level triggered by the microprocessor 44. For example, the first alert level will trigger the instant the person 100, wearing the wearable article 50, enters the defined area. If the person continues to remain within the defined area, the microprocessor 44 will sound successive alerts. In a preferred embodiment, the highest level of alert will culminate with the microprocessor 44 causing the modem 46 to establish a connection via the telephone coupling 32 to the telephone system and place a telephone call to the desired telephone number, followed by the desired warning message(s). It is possible however to program the microprocessor 44 to establish a connection via the telephone coupling 32 to the telephone system and place a telephone call to the desired telephone number in response to any of the alert levels. As those well skilled in the art will appreciate, the warning messages may consist of many different formats, including though not limited to: digital information such as an alarm monitoring station would receive and display for its operators; analog voice messages suitable for listening to by a person picking up a telephone receiver; or character information for display upon an pager, including both alphanumeric and conventional digital pagers.

The user next utilizes the microprocessor keyboard 72, and the microprocessor display 76 to program the microprocessor 44 with the telephone number(s) to be called in response to the selected alert level. The user next selects the Self Diagnostic Notify On/Off 68 to the desired position. This controls whether the microprocessor 44 will initiate a periodic alert either audibly through the speakers, or by utilizing the telephone system to communicate the status of the system with desired persons, e.g. either "system OK" or "system malfunction." The user next selects the "911" enable On/Off 66 to the desired position. The operation of this control allows the user to easily control whether the system will call the standard 911 emergency number in response to a selected alert level. This allows the operator the choice of disabling this feature when desired. The user next selects the External Speakers Enable On/Off 74 to the desired position.

The user next performs the RF gain adjustment. This adjustment is to ensure that the area to be protected is of the correct size to encompass the entire swimming pool 12 or such other area as desired. For this adjustment, the wearable article 50, after verifying the operation of the RF battery powered transmitter 60 by examining the transmitter-in-operation LED 52, is placed at a point beyond which it will be desired for an alert to occur. The gain control 62 is then adjusted until the alert occurs at that desired distance from the RFRS 20. This adjustment may be verified by moving the wearable article 50 closer and then farther away from the RFRS 20 and observing the response of the RFRS 20.

Although the invention has been particularly shown and described with reference to a preferred embodiment thereof, it will be understood by those skilled in the art that changes in form and detail may be made therein without departing from the spirit and scope of the invention.

What is claimed is:

1. A swimming pool drowning prevention safety system, comprising, in combination:

an article wearable by a person;

radio frequency transmitting device means coupled to said article for transmitting a radio frequency signal;

radio frequency receiving station means for receiving said radio frequency signal from said radio frequency transmitting device means when said radio frequency transmitting device means is within a user adjustable radio reception range of said radio frequency receiving station means; and means for signaling coupled to said radio frequency receiving station means for signaling when said person wearing said article has come within said user adjustable radio reception range of said radio frequency receiving station means;

wherein said means for signaling further comprises means for providing a lower alert level signal when said person wearing said article enters said user adjustable radio reception range of said radio frequency receiving station means and a higher alert level signal when said person continues to remain within said user adjustable radio reception range.

2. The system of claim 1 further comprising:

a battery power means coupled to said radio frequency transmitting device means for supplying operating power for said radio frequency transmitting device means; and a low-battery indicator coupled to said battery power means.

3. The system of claim 2 wherein said low-battery indicator is selected from the group consisting of LEDs, Liquid Crystal Displays and incandescent bulbs.

4. The system of claim 2 wherein said low-battery indicator is selected from the group consisting of electromechanical buzzers and piezo-electric sound alerts.

5. The system of claim 2 wherein said low-battery indicator is a vibrator means for causing a physical vibration by said article.

6. The system of claim 1 wherein said article further comprises a transmitter-in-operation indicator.

7. The system of claim 6 wherein said transmitter-in-operation indicator is selected from the group consisting of LEDs, Liquid Crystal Displays and incandescent bulbs.

8. The system of claim 1 wherein said radio frequency receiving station means is detachably coupled to a substantially permanently mounted base.

9. The system of claim 8 wherein said base and said radio frequency receiving station means further comprise a locking means for detachably securing said radio frequency receiving station means to said base.

10. The system of claim 1 wherein said radio frequency receiving station means has an adjustable gain control for varying the RF sensitivity of said radio frequency receiving station means.

11. The system of claim 1 further comprising ground fault interruption protection circuitry.

12. The system of claim 11 further comprising battery back-up means for supplying power to said radio frequency receiving station means.

13. The system of claim 1 wherein said article comprises an ornament for wear upon said person.

14. The system of claim 13 wherein said ornament comprises a pendent for wear upon said person.

15. The system of claim 13 wherein said ornament comprises a bracelet for wear upon said person.

16. The system of claim 1 wherein said lower alert signal comprises an audio message.

17. The system of claim 16 wherein said radio frequency receiving station further comprises means for:

automatically connecting to a telephone system;

dialing at least one telephone number; and transmitting at least one selected telephone alert message.

18. The system of claim 17 wherein said higher alert signal comprises said at least one selected telephone alert message.

* * * * *